United States Patent [19]

Knott

[11] 4,060,931

[45] Dec. 6, 1977

[54] TOY DUMP TRUCK HAVING CLOSED CONTAINER OF GRANULAR MATERIAL

[76] Inventor: Philip H. Knott, One San Antonio Place, San Francisco, Calif. 94133

[21] Appl. No.: 727,032

[22] Filed: Sept. 27, 1976

[51] Int. Cl.[2] ..... A63H 17/06

[52] U.S. Cl. ..... 46/112; 46/41; 46/214; 46/191

[58] Field of Search ..... 46/214, 41, 112

[56] References Cited

U.S. PATENT DOCUMENTS

| | | | |
|---|---|---|---|
| Re. 23,612 | 1/1953 | Abel | 46/41 |
| 690,852 | 1/1902 | Gordon | 46/41 X |
| 1,364,586 | 1/1921 | Sale | 46/214 |
| 1,627,270 | 5/1927 | Burnham | 46/41 X |

*Primary Examiner*—F. Barry Shay
*Attorney, Agent, or Firm*—Limbach, Limbach & Sutton

[57] ABSTRACT

A toy truck simulates the dumping of granular material within a closed container which is pivotally mounted to the truck chassis and has a transparent upward facing wall to exhibit the movement of the granular material during the simulated dumping. Pivoting the container upward from its normally horizontal position causes the material to slide from a visible dumping chamber to a concealed receiving chamber, and by further pivoting of the container the material is returned to the dumping chamber for repetition of simulated dumping. A metal foil membrane may be positioned for striking by the granules to produce a sound accompanying the simulated dumping. A self-operating valve may be used to control flow of the material.

18 Claims, 17 Drawing Figures

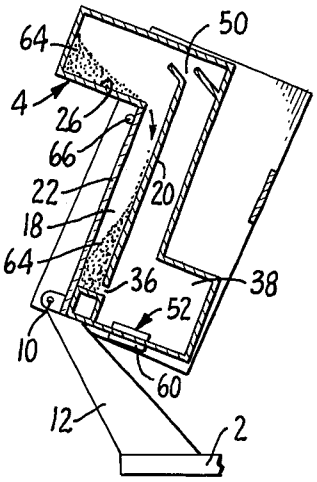
FIG. 7A.
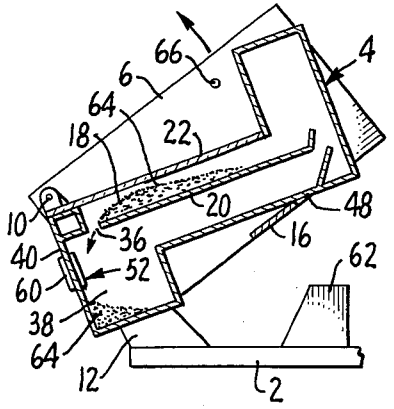
FIG. 7B.
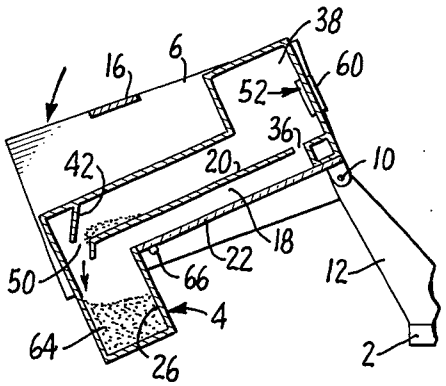
FIG. 7C.
FIG. 7D
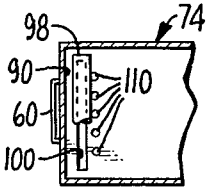
FIG. 10.
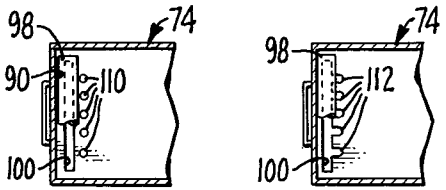
FIG. 11.
FIG. 12.
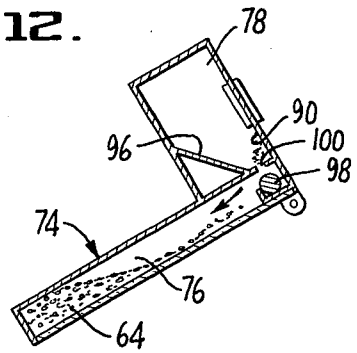
FIG. 9C.
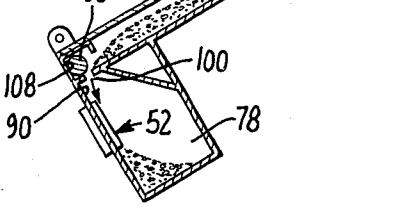
FIG. 9B.
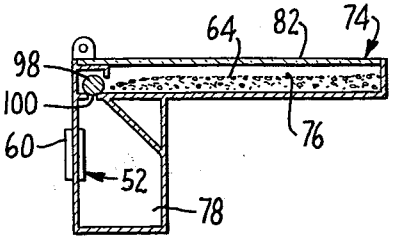
FIG. 9A.
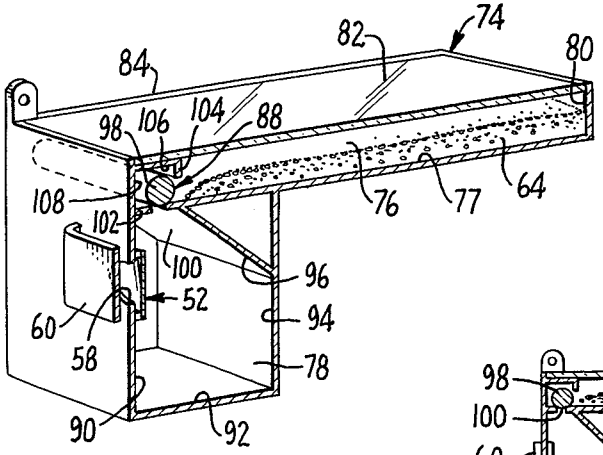
FIG. 8.

TOY DUMP TRUCK HAVING CLOSED CONTAINER OF GRANULAR MATERIAL

BACKGROUND OF THE INVENTION

Toy trucks have long been popular with children over a wide range of age groups. One of the frequent attractions of toy trucks is their ability to function on a small scale in a manner similar to their full-sized counterparts. Children often delight in placing various objects in toy moving vans and pick-up trucks and moving those trucks and objects about, as do the full-sized counterparts. Similarly, toy fire trucks are also popular with their ability to carry ladders and other objects for simulating the functions of real fire trucks.

One truck which heretofore has not been popular with parents, however, has been the dump truck. The problems of such a truck stem largely from its specific function, that of dumping sand or gravel in a desired location. Use of such a truck in a realistic manner indoors necessarily results in the dumping of some granular material, generally on the floor. Thus, realistic operation of such a toy dump truck has frequently created a mess on the floor of the owner's house. Nonetheless, the kinetic action of flowing granular material on the bed of a dump truck has long provided fascination for children and has made toy dump trucks attractive to them.

SUMMARY OF THE INVENTION

In view of the foregoing desirable features of toy dump trucks it is an object of this invention to provide a toy truck which simulates the dumping of granular material without expelling any such material onto the floor or ground. It is an additional object of this invention to provide such a toy truck in which the granular material is maintained within a closed container at all times. It is a further object of this invention to provide such a toy truck which simulates the sound of granular material being dumped. It is yet another object of this invention to provide such a toy truck in which the portion of the container from which the granular material is dumped may be refilled by that same granular material.

To achieve the foregoing plus additional objects, a toy truck for simulating the dumping of granular material is disclosed which comprises a truck chassis and a closed container containing granular material which is pivotally mounted to the truck chassis. The closed container includes a dumping chamber having a transparent upward facing wall and a receiving chamber disposed below the dump chamber, and an aperture of predetermined size connecting the dump chamber and the receiving chamber. This aperture thus permits granular material to pass from the dump chamber into the receiving chamber when the container is pivoted upwardly.

According to a preferred embodiment of this invention the pivot axis of the container is positioned generally horizontally and adjacent the rear of the container. Additionally, a sound producing membrane upon which the granular material impinges is associated with the receiving chamber to make clearly audible the sound of dumping the material. Various means are provided for refilling the dumping chamber after the granular material has been dumped from that chamber into the receiving chamber.

BRIEF DESCRIPTION OF THE DRAWINGS

FIGS. 7A–7D illustrates the dumping structure of the truck of FIG. 4, with that dumping structure in its various operative positions;

FIG. 8 is a rear perspective view, in section, of an alternative dumping structure for the truck of FIG. 4;

FIGS. 9A–9C are side sectional views of the dumping structure of FIG. 8 illustrating its various operative positions; and FIGS. 10, 11 and 12 are top sectional views of variations of the dumping structure of FIG. 8.

DESCRIPTION OF PREFERRED EMBODIMENTS

Figure 1:
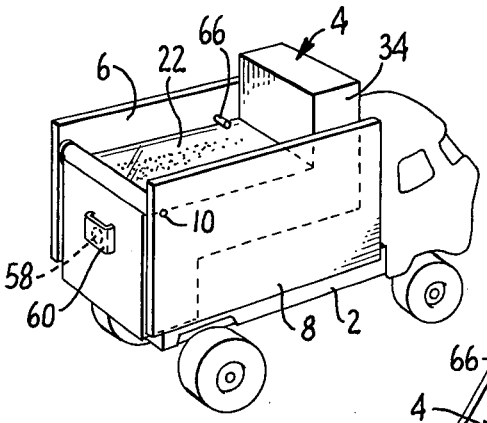
FIG. 1 represents the toy truck of this invention with its dumping structure in the normal horizontal position.

A preferred embodiment of the toy truck of this invention is illustrated in FIGS. 1 through 7. The truck comprises generally a conventional chassis 2, to which are pivotally mounted a closed container 4 and side panels 6 and 8. The container 4 is pivotally mounted by shaft 10 adjacent the rear of the container to support arms 12 and 14 attached to and extending upwardly from the truck chassis 2. This pivot shaft 10 permits the container 4 to be pivoted from its normal position extending generally horizontally and forwardly, shown in FIGS. 1, 4 and 7A, to the tilted position of FIGS. 2 and 7B and then to an inverted position shown in FIGS. 3 and 7C. Side panels 6 and 8 are conveniently joined together by connecting member 16 extending beneath the container 4 and by attachment to the ends of pivot shaft 10. By virtue of these connections any movement of one of the side panels 6 and 8 necessarily effects a corresponding movement of the other side panel.

As shown most clearly in FIGS. 4 and 7A through 7D, the container 4 of this embodiment includes a dumping chamber 18 generally defined by panel 20, upward facing wall 22, rear wall 24, forward walls 26, 28 and 30 and side walls 32 and 34. Between the rearmost position of panel 20 and rear wall 24 is formed a dumping aperture 36 connecting dumping chamber 18 with receiving chamber 38 which, in this normal position of the container, is positioned below the dumping chamber 18. This receiving chamber 38 is generaly defined by upper panel 20, extensions of side walls 32 and 34, rear wall 40, deflector panel 42 and walls 44, 46 and 48. A second aperture 50 between dumping chamber 18 and receiving chamber 38 is defined by deflector panel 42 and the forwardmost portion of panel 20. This second aperture 50 is involved in the refilling of the dumping chamber, as will be described below. From the illustrations, it may be seen that the dumping chamber 18 and the receiving chamber 38 are both generally L-shaped.

Attached to the rear wall 40 of receiving chamber 38 is a sound producing device 52 which comprises generally a square frame 54 over which is stretched a membrane 56 of metallic foil or other suitable material. This device 52 covers an aperture 58 through receiving chamber wall 40 and is in turn protected by shield 60 of thin metal or other suitable material added on the outside of wall 40 and spaced slightly therefrom.

The simulated dumping operation of the truck of this first embodiment may now be seen with reference to FIGS. 1 through 3 and 7A and 7B. When container 4 is in its normal position at rest, extending generally horizontally, the container is supported at the rear by its pivotal attachment through shaft 10 to the truck chassis 2 and at the front by the engagement of the downward facing portion of receiving chamber wall 48 with support block member 62 attached to truck chassis 2. In this position the granular material 64, which conveniently may be sand, gravel, beads, or other appropriate material, is at rest in dumping chamber 18 on panel 20. In this configuration the granular material 64 is readily visible through the transparent top panel 22, which conveniently may be formed of glass or rigid transparent plastic. All other panels are preferably of opaque material, suitably plastic, wood or metal. Thus, since the granular material 64 is visible only through the transparent panel 22, the appearance is given that the entire rear portion of the truck is filled with such granular material.

Figure 2:
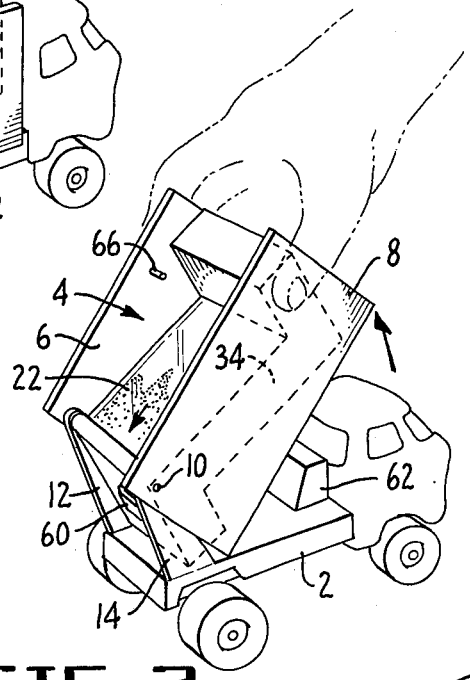
FIG. 2 illustrates the toy truck of FIG. 1 with the dumping structure lifted to a lifted, dumping position.
Figure 6:
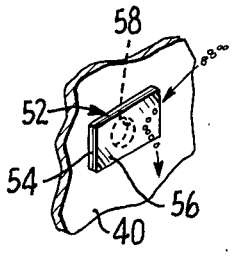
FIG. 6 is a fragmentary view of the sound producing device of the truck of FIGS. 1 through 5.

When it is desired to simulate the dumping operation of the granular material from the dumping chamber 18, the side panels 6 and 8 may be grasped between the thumb and fingers, as illustrated in phantom in FIG. 2, and pivoted to an orientation with the forward portion of the panels pointing forward and upward. While the side panels 6 and 8 are mounted for pivoting independently of the container 4, the member 16 joining the panels will engage the underside of bottom panel 48 and effect similar pivoting of the container 4 after a limited amount of such relative pivoting, as illustrated in FIG. 7B. When the side panels and container have been pivoted to the forward upward orientation of FIGS. 2 and 7B, the granular material 64 in the dumping chamber 18 will flow rearwardly along panel 20 and then downwardly through aperture 36 into receiving chamber 38. Since only top panel 22 is transparent and all other panels, including rear panel 40, are opaque, the appearance is given that the granular material is being dumped from the dumping chamber and disappearing. Additionally, the limited pivoting of side panels 6 and 8 relative to container 4 effects an appearance of increased depth, thus suggesting further the emptying of the dumping chamber 18. As the granular material 64 flows from dumping chamber 18 into receiving chamber 38, the path necessarily causes it to impinge upon the membrane 56 of the sound producing 52. The impingement of this granular material upon the membrane effectively amplifies the sound of the granular material falling, thus further enhancing the illusion of a dumping operation. This sound is transmitted outside the container 4 through the aperture 58.

After the container 4 has been held for several seconds in its dumping orientation with the forward portion pointing forward and upward, the granular material 64 is substantially emptied from the dumping chamber 18 into the receiving chamber 38. At this point it is desirable to refill the dumping chamber so that the simulated dumping operation may be repeated as desired. This refilling operation is illustrated in FIGS. 3 and 7C and D.

Figure 3:
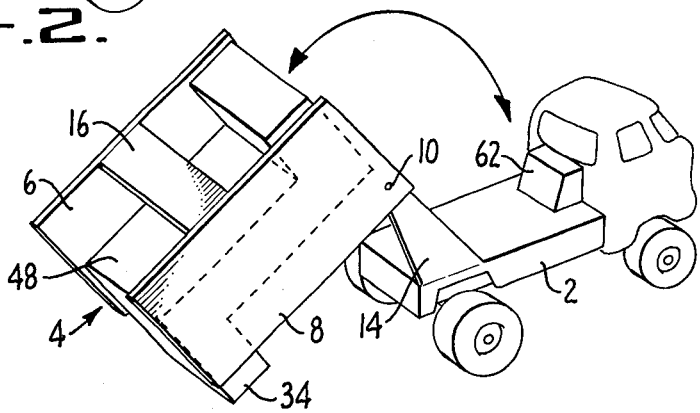
FIG. 3 illustrates the toy truck of FIG. 1 with the dumping structure pivoted to its inverted, refilling position.
Figure 4:
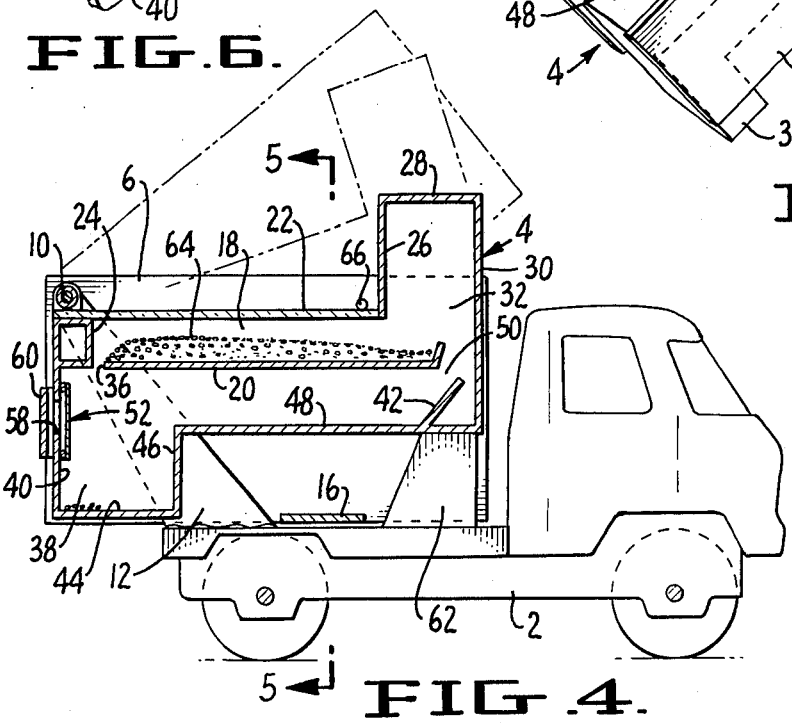
FIG. 4 is a side sectional view of one embodiment of the truck of FIG. 1.
Figure 5:
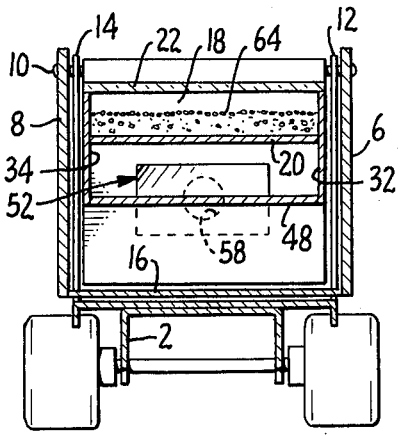
FIG. 5 is a front sectional view of the truck of FIG. 4, taken along 5—5.

Refilling is accomplished by continuing the pivoting movement of the side panels 6 and 8 and thus of the container 4 until the container 4 has been rotated to an inverted position, at least 180° from its normal horizontally extending position, and preferably somewhat more than 180°, as illustrated in FIGS. 3 and 7C. In this orientation the portion of container 4 which is normally at the front has been brought to a rearwardly and downwardly facing orientation. In this orientation the granular material 64 which was resting in the lower portion of receiving chamber 38 flows along the reverse side of panel 20 and is deflected by panel 42 through aperture 50 back into dumping chamber 18, as illustrated in FIG. 7C. It may be noted that at least one pin 66 projecting inwardly from side panel 6 is provided to engage dumping chamber top panel 22 when in this inverted position, thus with member 16 defining the limits of relative pivotal movement between side panels 6 and 8 and container 4. As the side panels are pivoted back toward their normal forwardly extending position the engagement of this peg 66 with dumping chamber panel 22 causes the container 4 to pivot correspondingly, as illustrated in FIG. 7D. Under the influence of gravity the granular material 64 will thus flow along wall 26 back into the portion of the dumping chamber covered by transparent panel 22. Thus, the refilling operation is completed as side panels 6 and 8 and container 4 are pivoted back to the normal horizontal position illustrated in FIGS. 1, 4 and 7A. The aperture 36 is dimensioned such that when the pivoting of FIGS. 7C and 7D is done in a fairly rapid manner, relatively little of the granular material 64 will flow from the dumping chamber 18 into the receiving chamber 38. Refilling aperture 50, however, is of a substantially larger size, providing a greater rate of flow to speed the refilling process.

An alternative embodiment of the dumping structure of FIGS. 1 through 7 is illustrated in the sectional views of FIGS. 8 and 9A through 9C. In this embodiment all portions of the toy truck remain substantially identical with that of the previous embodiment with the exception of the closed container, which is designated generally by reference numeral 74. Accordingly, in the interest of clarity, only the container 74 is illustrated. The container 74 comprises, generally, dumping chamber 76 and receiving chamber 78. Dumping chamber 76 is defined generally by bottom panel 77, front panel 80, transparent top panel 82, opposed side panels 84 and 86 (not shown in the sectional view), and a self-regulating dumping valve generally indicated by numeral 88. All portions of container 74 except for top panel 82 are preferably of opaque material, as with the previous embodiment. Receiving chamber 78 is positioned below dumping chamber 76 and is connected thereto through dumping valve 88. Receiving chamber 78 comprises generally extensions of side panels 84 and 86 and walls 90, 92, 94 and 96. A sound producing device, suitably the device 52 of the preceding embodiment, is associated with rear panel 90 of the receiving chamber 78. Similarly, a protective device 60 is positioned over the aperture 58 behind the device 52.

Valve 88 is provided to limit the rate of flow of granular material 64 from the dumping chamber into the receiving chamber during the simulated dumping operation, while providing for rapid refilling of the dumping chamber from the receiving chamber. This valve 88 comprises a rod-like or cylindrical member 98 which nests lightly in the aperture 100 joining dumping chamber 76 with receiving chamber 78. Rod 98 is loosely restrained in its movement by lip 102 defining the rear portion of slot 100, lip 104 and valve chamber walls 106 and 108. In this embodiment the valve member 98 can move slightly rearwardly to effect a partial opening of the aperture 100 for dumping or, in an inverted position, can move toward the top wall 106 of the valve chamber, thus opening wide the aperture 100 for refilling.

The manner of operation of the dumping and refilling container 74 of this embodiment is illustrated in FIGS. 9A through 9C. FIG. 9A represents the container 74 in its normal, generally horizontally extending orientation, similar to FIG. 7A in the previous embodiment. In this orientation the granular material 64 is depicted in dumping chamber 76, being retained there by the valve member 98 closing the aperture 100. When the container 74 is tilted to a dumping orientation pointing forwardly and upwardly as illustrated in FIG. 9B, the valve member 98 is caused under the influence of gravity to move rearwardly to open slightly the aperture 100. In this tilted orientation, with the valve only partially blocking the aperture, the granular material 64 may drain gradually from dumping chamber 76 into receiving chamber 78 to simulate dumping. As described in the previous embodiment, the granular material impinges upon the membrane of sound producing device 52 as it flows into receiving chamber 78.

When the dumping chamber 76 has been emptied by the simulated dumping operation and it is desired to refill the same, the container 74 is pivoted to the inverted position illustrated in FIG. 9C. In this inverted orientation the valve member 98 is caused by gravity to move completely clear of the aperture 100, thus opening it to its widest extent. At the same time the granular material is funneled by receiving chamber walls 90 and 96 back through that aperture 100 and thus into the dumping chamber 76. When the granular material 64 has all flowed back into the dumping chamber 76, the container 74 may quickly be pivoted back to the normal orientation of FIG. 9A with little flow of the granular material from the dumping chamber.

FIGS. 10 through 12 illustrate variations in the self-adjusting dumping and refilling valve structure of the container 74 of FIG. 8. In each of the embodiments of FIGS. 10 through 12 dumping apertures are provided which remain at all times uncovered by valve member 98, even when that valve member is nesting in slot 100. In both FIGS. 10 and 11 a plurality of dumping apertures 110 are positioned ahead of the slot 100. By virtue of these additional apertures 110 the granular material from the dumping chamber may gradually be transferred to the receiving chamber when the container 74 is tilted as in FIG. 9B, even without any movement of the valve member 98. In FIG. 10 the valve member 98 and slot 100 are positioned as in FIGS. 8 and 9A through 9C, such that the valve member 98 may move slightly rearwardly to open a portion of slot 100 when the container is tilted. In the embodiment of FIG. 11 the slot 100 is positioned closer adjacent rear wall 90 such that the dumping member 98 will remain closing that slot when the container is tilted. Thus, in FIG. 11 all dumping of the granular material will occur through apertures 110, while refilling may occur primarily through slot 100, in the manner illustrated in FIG. 9C.

In the embodiment of FIG. 12 the separate dumping apertures 110 of FIGS. 10 and 11 are replaced by U-shaped extensions 112 of slot 100. In this embodiment, similar to that of FIG. 11, the dumping, when the container 74 is tilted to the position of FIG. 9B, will occur through the portions of slot extensions 112 which remain uncovered by the valve member 98 and thus comprise the dumping apertures. When the container 74 is inverted for refilling the valve member 98 will again uncover slot 100 completely such that refilling occurs primarily through slot 100.

As may be seen in the description of the several preferred embodiments, a toy truck according to this invention may realistically simulate the dumping of granular material in the manner of an actual dump truck but without the attendant spillage on the ground or floor on which the truck is sitting.

While several preferred embodiments of this invention have been described and illustrated in detail, it is to be understood that they are merely illustrative of the principles of the invention and in no way limit the scope of the invention. Accordingly, since numerous variations and modifications, all within the scope of this invention, will readily occur to those skilled in the art, this invention is to be limited solely by the claims appended hereto.

What is claimed is:

1. A toy truck for simulating the dumping of granular material, comprising
- a truck chassis and
- a closed container containing granular material, said container being pivotally mounted to said truck chassis and comprising
  - a dumping chamber having a transparent upwardly facing wall, said dumping chamber normally extending in a generally horizontal direction,
  - a receiving chamber disposed below said dumping chamber and
  - an aperture of predetermined size connecting said dumping chamber and said receiving chamber, said aperture being positioned to permit said granular material to pass from said dumping chamber to said receiving chamber when said container is pivoted to an orientation with the forward portion thereof pointing forward and upward.

2. A toy truck according to claim 1 wherein said container pivot axis is positioned generally horizontally and adjacent the rear of said container.

3. A toy truck according to claim 1 further comprising sound producing means associated with said receiving chamber and comprising a membrane upon which said granular material impinges when flowing from said dumping chamber to said receiving chamber.

4. A toy truck according to claim 3 wherein said membrane is positioned over a hole in a wall of said receiving chamber.

5. A toy truck according to claim 3 wherein said membrane comprises a metallic foil material.

6. A toy truck according to claim 1 further comprising side panels adjacent said container and pivotally mounted to said truck chassis for pivotal movement independently of said container.

7. A toy truck according to claim 6 wherein said side panel pivot axis is coaxial with said container pivot axis.

8. A toy truck according to claim 6 further comprising means for limiting the pivotal movement of said side panels relative to said container, whereby movement of said side panels in excess of said limited amount may effect pivotal movement of said container as well.

9. A toy truck according to claim 1 further comprising means for refilling said dumping chamber with granular material from said receiving chamber.

10. A toy truck according to claim 9 wherein said pivotal mounting of said container comprises means for pivoting said container at least 180° from its normal generally horizontal position to an inverted position.

11. A toy truck according to claim 10 wherein said dumping chamber refilling means comprises means for directing said granular material from said receiving chamber to said dumping chamber when said container is inverted.

12. A toy truck according to claim 9 further comprising means for limiting the rate of flow of material from said dumping chamber to said receiving chamber during the dumping operation to a lower rate than from receiving chamber to said dumping chamber during said refilling operation.

13. A toy truck according to claim 12 wherein said flow limiting means comprises separate apertures of differing sizes for said two different flows.

14. A toy truck according to claim 12 wherein said flow limiting means comprises self-adjusting valve means which adjust differently for said two flows.

15. A toy truck according to claim 14 wherein said valve means comprises said aperture and a cylindrical member loosely restrained and extending transversely across said container adjacent said aperture and restrained in movement to cause partial blockage of said aperture when said container is pivoted to said forward upward orientation for dumping and to move a substantially non-blocking position when said container is pivoted to an orientation pointing rearwardly for refilling.

16. A toy truck according to claim 12 wherein said flow limiting means comprises in combination at least one dumping aperture of predetermined size positioned between said dumping chamber and said receiving chamber for allowing a flow of said granular material between said dumping chamber and receiving chamber at a predetermined rate during the dumping operation;

at least one return flow aperture between said dumping chamber and said receiving chamber to provide for flow of said granular material from said receiving chamber back into said dumping chamber during the refilling operation; and self-adjusting valve means for blocking said return flow aperture when said container is pivoted to said forward upward orientation and for opening said return flow aperture when the container is pivoted to an orientation pointing rearwardly, whereby said return flow aperture is blocked during the flow of material from the dumping chamber to the receiving chamber but is opened during the return flow from the receiving chamber to the dumping chamber.

17. A toy truck according to claim 16 wherein said dumping aperture and said return flow aperture comprise different portions of a common aperture.

18. A toy truck according to claim 16 wherein said dumping aperture is separated from said return flow aperture.

* * * * *